US006685335B1

(12) United States Patent
Yeh et al.

(10) Patent No.: US 6,685,335 B1
(45) Date of Patent: Feb. 3, 2004

(54) STRUCTURE OF A CAMPING LAMP

(76) Inventors: Chin-Chung Yeh, C/O PMB #1008, 1867 Ygnacio Valley Rd., Walnut Creek, CA (US) 94598-3214; Hsing-Wang Lin, PMB #1008, 1867 Ygnacio Valley Rd., Walnut Creek, CA (US) 94598-3214

( * ) Notice: Subject to any disclaimer, the term of this patent is extended or adjusted under 35 U.S.C. 154(b) by 0 days.

(21) Appl. No.: 10/265,229

(22) Filed: Oct. 7, 2002

(51) Int. Cl.[7] ..... F21V 33/00
(52) U.S. Cl. ..... 362/184
(58) Field of Search ..... 362/184, 185, 362/186, 194, 202, 205, 208, 237, 240, 800

(56) References Cited

U.S. PATENT DOCUMENTS 5,622,423 A * 4/1997 Lee ..... 362/800
5,697,695 A * 12/1997 Lin et al. ..... 362/184
6,213,623 B1 * 4/2001 Campman ..... 362/184
6,305,820 B1 * 10/2001 Poon ..... 362/186
6,394,630 B1 * 5/2002 Skidmore et al. ..... 362/186

* cited by examiner

*Primary Examiner*—Y. My Quach-Lee
(74) *Attorney, Agent, or Firm*—Leong C. Lei

(57) ABSTRACT

A camping lamp includes a tubular body having a plurality of chambers in each of which is fitted a battery, the tubular body being formed with a through hole close to an end thereof and a notch close to another end thereof, a cap having a protuberance adapted to engage with the notch of the tubular body, a circular contact plate provided with a plurality of springs at one side thereof being fixedly fitted into the first end of the tubular body, with each of the springs contacting an electrode of the battery, a circular circuit board provided with a plurality of light emitting diodes on one side thereof and a switch on another side thereof and fixedly mounted into the tubular body, with the switch protruding out of the through hole of the tubular body for controlling electrical connection between the light emitting diodes and the battery, a tubular transparent sleeve fixedly mounted on the circular circuit board so as to enclose the light emitting diodes therein, a free end of the tubular transparent sleeve having threads, a transparent housing put on to the tubular transparent sleeve, and a cover having a neck provided with internal threads engaged with the threads of the tubular transparent sleeve.

3 Claims, 4 Drawing Sheets

STRUCTURE OF A CAMPING LAMP

BACKGROUND OF THE INVENTION

1. Field of the Invention

This invention is related to an improvement in the structure of a camping lamp and in particular to one which can convert the direct light of light emitting diodes into radial light.

2. Description of the Prior Art

It has been found that incandescent lamps and florescent lamps are generally used for camping. However, such lamps require a lot of electric power for operation thereby making it necessary for the user to carry a large amount of batteries and therefore causing much inconvenience in use. Hence, a lamp with light emitting diodes has been proposed to mitigate this drawback, but such a lamp is limited in illumination area and can only give light to the front thus making it unfit for practical use.

Therefore, it is an object of the present invention to provide an improvement in the structure of a camping lamp which can obviate and mitigate the above-mentioned drawbacks.

SUMMARY OF THE INVENTION

This invention is related to an improvement in the structure of a camping lamp.

It is the primary object of the present invention to provide an improvement in the structure of a camping lamp which can convert direct light into radial light thereby increasing the illumination effect and area.

According to a preferred embodiment of the present invention, a camping light includes a tubular body having a plurality of chambers in each of which is fitted a battery, the tubular body being formed with a through hole close to an end thereof and a notch close to another end thereof, a cap having a protuberance adapted to engage with the notch of the tubular body, a circular contact plate provided with a plurality of springs at one side thereof being fixedly fitted into the first end of the tubular body, with each of the springs contacting an electrode of the battery, a circular circuit board provided with a plurality of light emitting diodes on one side thereof and a switch on another side thereof and fixedly mounted into the tubular body, with the switch protruding out of the through hole of the tubular body for controlling electrical connection between the light emitting diodes and the battery, a tubular transparent sleeve fixedly mounted on the circular circuit board so as to enclose the light emitting diodes therein, a free end of the tubular transparent sleeve having threads, a transparent housing put on to the tubular transparent sleeve, and a cover having a neck provided with internal threads engaged with the threads of the tubular transparent sleeve.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
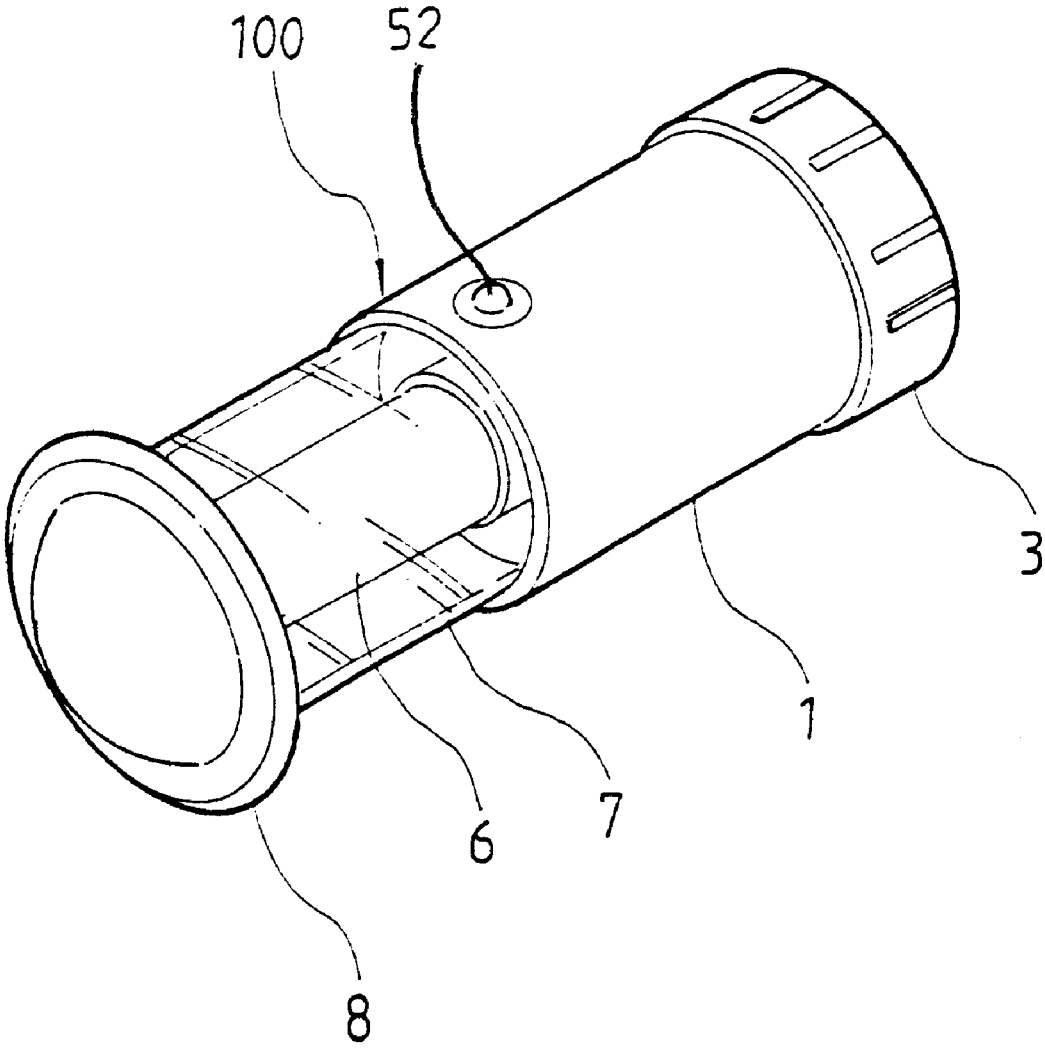
FIG. 1 is a perspective view of the present invention.
Figure 2:
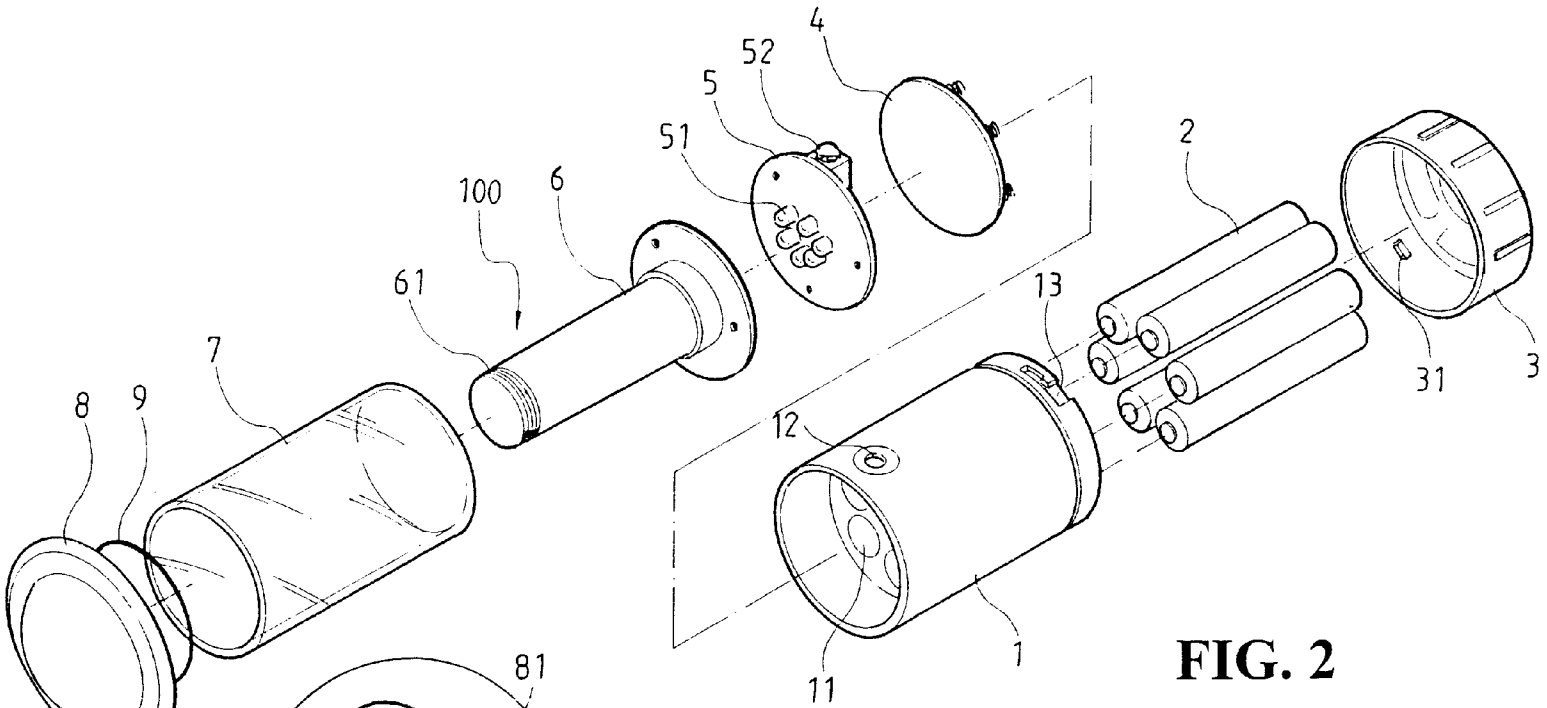
FIG. 2 is an exploded view of the present invention.
Figure 2A:
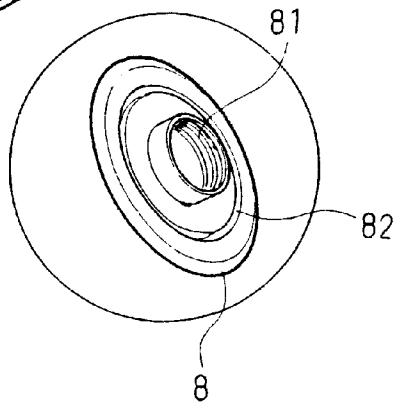
FIG. 2A is a perspective view of the cover.

With reference to the drawings and in particular to FIGS. 1, 2 and 2A thereof, the camping lamp 100 according to the present invention generally comprises a tubular body 1 having a plurality of chambers 11 in each of which is fitted a battery 2. The tubular body 1 is formed with a through hole 12 close to the front end thereof and a notch 13 close to the other end which is adapted for engaging with a protuberance 31 of a cap 3.

A circular contact plate 4 with a plurality of springs (shown but not numbered) at one side thereof is fixedly fitted by any well known means into the front end of the tubular body 1, with the springs contacting the electrodes of the batteries 2. A circular circuit board 5 with a plurality of light emitting diodes 51 on one side and a switch 52 on the other side is fixedly mounted by any well known means into the tubular body 1, so that the switch 52 protrudes upwardly out of the through hole 12 of the tubular body 1 for controlling the electrical connection between the light emitting diodes 51 and the batteries 2.

A tubular transparent sleeve 6 processed with sand blasting or containing florescent material is fixedly mounted by any well known means on the circular circuit board 5 so as to enclose the light emitting diodes 51 therein. The free end of the tubular transparent sleeve 6 has threads 61. A transparent housing 7 is put on to the tubular transparent sleeve 6, so that the threads 61 of the tubular transparent sleeve 6 are engaged with the internal threads of the neck 81 of the cover 8. The cover 8 is formed with a groove 82 surrounding the neck 81 and an O-ring 9 is fitted in the groove 82 for tightening the engagement between the cover 8 and the transparent housing 7.

When in use, the switch 52 is turned on to close the circuit between the light emitting diodes 51 and the batteries 2 thereby causing the light emitting diodes 51 to give light. Meanwhile, by means of the tubular transparent sleeve 6, the direct light for the light emitting diodes 51 is converted into radial light thereby increasing the illumination effect.

Figure 3:
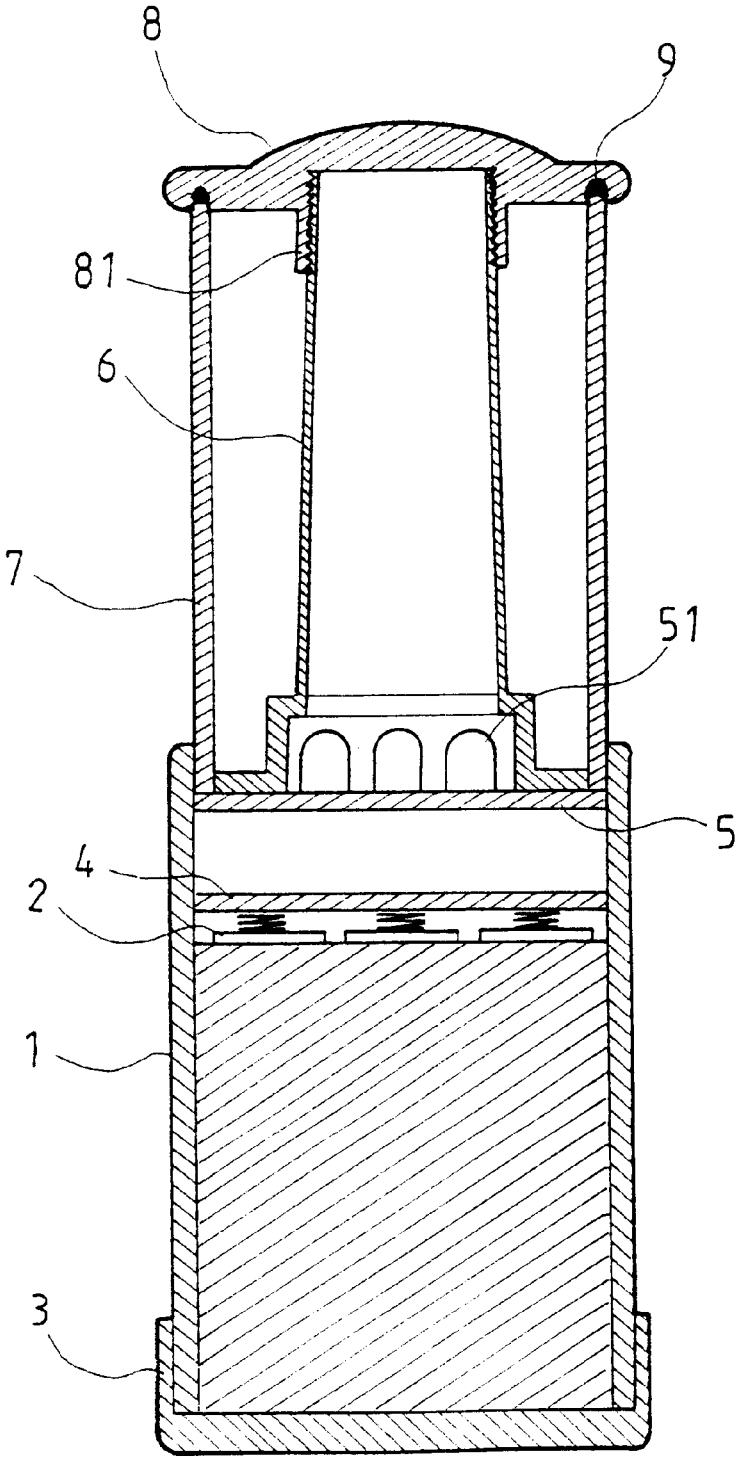
FIG. 3 is a sectional view of the present invention.
Figure 4:
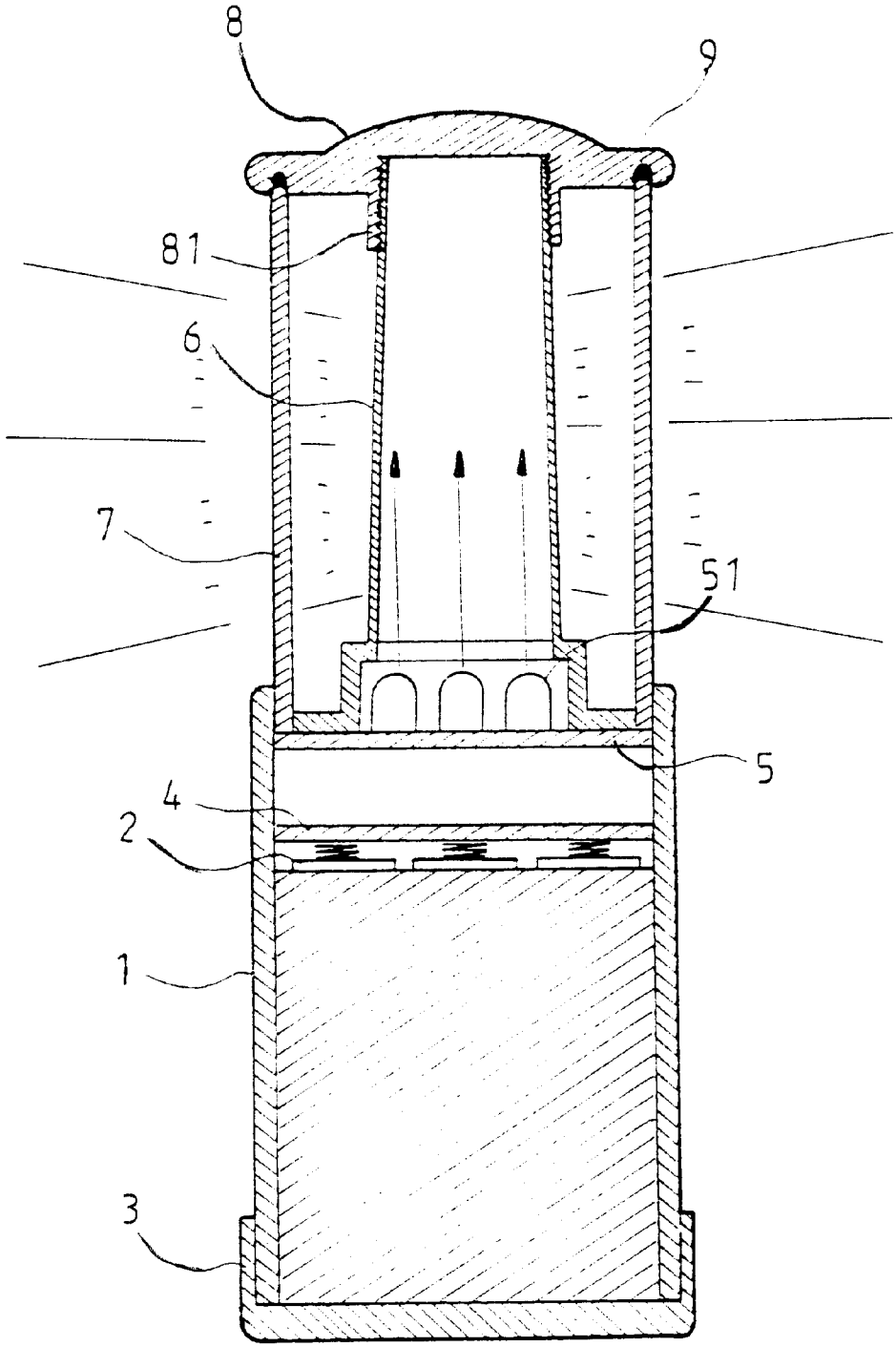
FIG. 4 is a sectional view showing the working condition of the present invention.

Referring to FIGS. 3 and 4, the light emitting diodes 51 are positioned on the bottom of the tubular transparent sleeve 6 and the transparent housing 7 is kept between the circular circuit board 5 and the cover 8. When the light emitting diodes 51 give light, the direct light from the light emitting diodes 51 will be converted into radial light thereby increasing the illumination area.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A camping lamp comprising:

a tubular body having a plurality of chambers in each of which is fitted a battery, said tubular body being formed with a through hole close to an end thereof and a notch close to another end thereof;

a cap having a protuberance adapted to engage with said notch of said tubular body;

a circular contact plate provided with a plurality of springs at one side thereof being fixedly fitted into said first end of said tubular body, with each of said springs contacting an electrode of said battery;

a circular circuit board provided with a plurality of light emitting diodes on one side thereof and a switch on another side thereof and fixedly mounted into said tubular body, with said switch protruding out of said through hole of said tubular body for controlling electrical connection between said light emitting diodes and batteries;

a tubular transparent sleeve fixedly mounted on said circular circuit board so as to enclose said light emitting diodes therein, a free end of said tubular transparent sleeve having threads;

a transparent housing put on to said tubular transparent sleeve; and a cover having a neck provided with internal threads engaged with said threads of said tubular transparent sleeve.

2. The camping lamp as claimed in claim 1, wherein said tubular transparent sleeve is processed with sand blasting or contains florescent material.

3. The camping lamp as claimed in claim 1, wherein said cover is formed with a groove in which is fitted an O-ring for preventing water from entering therein.

* * * * *